US010415933B1

(12) United States Patent
Kleck et al.

(10) Patent No.: US 10,415,933 B1
(45) Date of Patent: Sep. 17, 2019

(54) REAL-TIME BALLISTIC SOLUTIONS FOR MOVING-TARGET AIMING CALCULATIONS

(71) Applicant: Leupold & Stevens, Inc., Beaverton, OR (US)

(72) Inventors: Jeffrey Kleck, Hillsboro, OR (US); Eric Tyler Overstreet, Lake Oswego, OR (US); Victoria J. Peters, Vernonia, OR (US)

(73) Assignee: Leupold & Stevens, Inc., Beaverton, OR (US)

( * ) Notice: Subject to any disclaimer, the term of this patent is extended or adjusted under 35 U.S.C. 154(b) by 337 days.

(21) Appl. No.: 15/002,313

(22) Filed: Jan. 20, 2016

Related U.S. Application Data

(60) Provisional application No. 62/105,687, filed on Jan. 20, 2015.

(51) Int. Cl.
*F41G 3/08* (2006.01)
*F41G 3/06* (2006.01)
*F41G 1/38* (2006.01)

(52) U.S. Cl.
CPC ..... *F41G 3/08* (2013.01); *F41G 1/38* (2013.01); *F41G 3/06* (2013.01)

(58) Field of Classification Search
CPC ..... F41G 1/12; F41G 1/16; F41G 1/38; F41G 1/473; F41G 3/065; F41G 3/08; F41G 3/06; F41G 3/12
See application file for complete search history.

(56) References Cited

U.S. PATENT DOCUMENTS 3,948,587 A 4/1976 Rubbert
4,695,161 A 9/1987 Reed
(Continued)

FOREIGN PATENT DOCUMENTS

DE 102013019281 A1 5/2015
WO 2006060489 A2 6/2006
(Continued)

OTHER PUBLICATIONS

"New Wind-Reading LIDAR LaserScope", AccurateShooter.com, archived at http://webarchiveorgweb/20110513032350/http://www.accurateshooter.com/optics/new-wind-reading-lidar-laserscope, dated May 13, 2011, 2 pages.
(Continued)

*Primary Examiner* — Benjamin P Lee
(74) *Attorney, Agent, or Firm* — Stoel Rives LLP; Robert R. Teel

(57) ABSTRACT

Disclosed are techniques for determining an aiming adjustment amount, in terms of both vertical and horizontal aiming adjustments, to shoot a target at a target range by iteratively solving for the projectile trajectory (e.g., projectile drop or path and deflection) such that the iteratively calculated projectile trajectory is determined to pass through the target location within a predetermined threshold amount (e.g., at a projectile path calculation of about zero). Also disclosed are techniques for indicating whether a projectile has supersonic, transonic, or subsonic speed at a given range. Additionally, techniques are disclosed for iteratively determining an aiming adjustment amount that compensates for a moving target.

32 Claims, 9 Drawing Sheets

(56) References Cited

U.S. PATENT DOCUMENTS

| | | | | |
|---|---|---|---|---|
| 5,140,329 | A | 8/1992 | Maughan et al. | |
| 5,359,404 | A | 10/1994 | Dunne | |
| 5,631,654 | A | 5/1997 | Karr | |
| 6,269,581 | B1 | 8/2001 | Groh | |
| 6,516,699 | B2 | 2/2003 | Sammut et al. | |
| 7,242,462 | B2 | 7/2007 | Huang | |
| 7,654,029 | B2 * | 2/2010 | Peters | F41G 1/473 356/11 |
| 7,703,679 | B1 | 4/2010 | Bennetts et al. | |
| 8,172,139 | B1 | 5/2012 | McDonald et al. | |
| 8,281,995 | B2 | 10/2012 | Bay | |
| 2002/0197584 | A1 | 12/2002 | Kendir et al. | |
| 2004/0231220 | A1 | 11/2004 | McCormick | |
| 2005/0252062 | A1 | 11/2005 | Scrogin et al. | |
| 2006/0010760 | A1 | 1/2006 | Perkins et al. | |
| 2007/0137088 | A1 * | 6/2007 | Peters | F41G 1/473 42/111 |
| 2007/0137091 | A1 | 6/2007 | Cross et al. | |
| 2009/0188976 | A1 | 7/2009 | Gunnarsson et al. | |
| 2009/0266892 | A1 | 10/2009 | Windauer et al. | |
| 2009/0320348 | A1 | 12/2009 | Kelly | |
| 2010/0117888 | A1 | 5/2010 | Simon | |
| 2010/0301116 | A1 * | 12/2010 | Bennetts | F41G 1/12 235/404 |
| 2011/0114725 | A1 | 5/2011 | Young | |
| 2012/0000979 | A1 * | 1/2012 | Horvath | F41G 1/38 235/407 |
| 2012/0186130 | A1 * | 7/2012 | Tubb | F41G 1/38 42/122 |
| 2013/0091754 | A1 * | 4/2013 | Galanti | F41G 1/44 42/111 |
| 2013/0181047 | A1 * | 7/2013 | Santini | F41G 1/473 235/404 |
| 2013/0206836 | A1 | 8/2013 | Paterson et al. | |
| 2013/0286216 | A1 | 10/2013 | Lupher et al. | |
| 2015/0106046 | A1 * | 4/2015 | Chen | G01B 11/00 702/94 |
| 2015/0345906 | A1 | 12/2015 | Varshneya et al. | |

FOREIGN PATENT DOCUMENTS

| | | | | |
|---|---|---|---|---|
| WO | 2012007825 | A1 | 1/2012 | |
| WO | 2015075036 | A1 | 5/2015 | |
| WO | WO-2016118665 | A1 * | 7/2016 | F41G 1/473 |

OTHER PUBLICATIONS

McDonald, et al., "About Exterior Ballistics from the Sierra Manuals: 5th Edition Manual Exterior Ballistics Section", ExteriorBallistics.com, archived at http://web.archive.org/web/20131125223951/http://www.exteriorballistics.com/ebexplained/index.cfm, dated at least one year before Jan. 18, 2014, 71 pages.

McDonald, "Inclined Fire", ExteriorBallistics.com, archived at http://web.archive.org/web/20131128053832/http://www.exteriorballistics.com/ebexplained/article1.html, dated Jun. 2003, 8 pages.

Perry, "Sierra Infinity 7.2.1—User Guide", Sierra Bullets, https://www.sierrabullets.com/documents/Infinity7.2.1.UserGuide.pdf, version 1.0, dated Mar. 14, 2015, 59 pages.

Non-Final Office action from U.S. Appl. No. 15/544,848, dated May 14, 2018, 8 pages.

Kleck,Jeffrey et al.,"Real-Time Ballistic Solutions for Calculating an Aiming Adjustment and for Indicating a Subsonic Threshold," U.S. Appl. No. 15/544,848, filed Jul. 19, 2017, 29 pages.

* cited by examiner

| Range (Yards) | Bullet Path (Inches) | Bullet Path (MOA) | Bullet Drop (Inches) | Deflection (Inches) | Deflection (MOA) | Velocity (Ft/Sec) | Energy (Ft-Lbs) | Time (Seconds) |
|---|---|---|---|---|---|---|---|---|
| 0 | -3.00 | 0.0 | 0.00 | 0.00 | 0.0 | 2,500.0 | 3,466.1 | -1.000 |
| 50 | -2.47 | -4.7 | -0.71 | -0.14 | -0.3 | 2,425.0 | 3,288.1 | -0.9392 |
| 100 | -3.41 | -3.3 | -2.88 | -0.57 | -0.5 | 2,370.9 | 3,117.4 | -0.8768 |
| 150 | -5.89 | -3.7 | -6.60 | -1.29 | -0.8 | 2,307.8 | 2,953.6 | -0.8126 |
| 200 | -10.00 | -4.8 | -11.95 | -2.33 | -1.1 | 2,245.6 | 2,796.5 | -0.7468 |
| 250 | -15.84 | -6.0 | -19.02 | -3.69 | -1.4 | 2,184.3 | 2,646.0 | -0.6790 |
| 300 | -23.49 | -7.5 | -27.92 | -5.39 | -1.7 | 2,124.0 | 2,501.9 | -0.6094 |
| 350 | -33.08 | -9.0 | -38.74 | -7.43 | -2.0 | 2,064.6 | 2,363.9 | -0.5378 |
| 400 | -44.70 | -10.7 | -51.60 | -9.85 | -2.4 | 2,006.2 | 2,232.1 | -0.4641 |
| 450 | -58.48 | -12.4 | -66.62 | -12.64 | -2.7 | 1,948.9 | 2,106.3 | -0.3882 |
| 500 | -74.55 | -14.2 | -83.92 | -15.83 | -3.0 | 1,892.5 | 1,986.2 | -0.3101 |

REAL-TIME BALLISTIC SOLUTIONS FOR MOVING-TARGET AIMING CALCULATIONS

RELATED APPLICATION

This application claims benefit of U.S. Provisional Patent Application No. 62/105,687, filed Jan. 20, 2015, which is incorporated herein by reference.

TECHNICAL FIELD

This disclosure relates generally to techniques for computing ballistic solutions in real time and, more particularly, to optical sighting devices implementing such techniques.

BACKGROUND INFORMATION

As shown in FIG. 1, a bullet or other projectile traverses a curved trajectory as it falls and decelerates while traveling from a point at which it departs a weapon to a point of impact (i.e., a target location). Due to its curved trajectory, the projectile will intersect an aiming line of sight at one or two ranges and pass below or above it at other ranges. A sight-in range (so-called zero range, zeroed-in range, or true zero) of the weapon and sight combination is the range at which a line of sight intersects a projectile's curved trajectory at a known horizontal reference distance, such as 200 yards or meters, so that projectiles shot from the weapon impact a target at the reference distance coinciding with a reference aiming point of crosshairs or another aiming mark of a riflescope (or other sighting device).

The aforementioned trajectory and the projectile's position thereon depend on ballistic characteristics, such as projectile weight, drag, and initial velocity (e.g., muzzle velocity), and on other factors characterized by exterior point mass ballistics. The principles of exterior point mass ballistics, or simply exterior ballistics, are well understood and have been expressed in mathematical terms in scientific literature. See, for example, E. J. McShane et al., "Exterior Ballistics," University of Denver Press (1953); Bryan Litz, "Applied Ballistics for Long Range Shooting," Applied Ballistics, LLC, 2nd edition (2011); and R. L. McCoy, "Modern Exterior Ballistics," Schiffer Publishing, Ltd., 2nd edition (2012), all of which are incorporated herein by reference as background information. In short, however, exterior ballistics equations may be used for calculating a projectile's position along its curved trajectory.

The aforementioned equations have been implemented, to various degrees, in exterior ballistics software applications. Ballistics software typically includes a library of ballistic coefficients and muzzle velocities for a variety of particular cartridges (also called an ammunition load, or simply, load). A user selects from the library an ammunition type, which serves as an input for ballistic calculations performed by the software. The ballistics software also allows a user to input target conditions, such as the elevation angle from level shooting and the range to the target; environmental conditions, including geospatial and meteorological conditions; and weapon configuration conditions such as sight height and zero range. Based on the user input, ballistics software applications may then calculate and provide as output various ballistics trajectory parameters. A calculated ballistics trajectory parameter may define a calculated trajectory in terms of projectile drop amounts that are the vertical component from a line of departure (e.g., a bore centerline) to points along the calculated trajectory, projectile path amounts at trajectory points perpendicular to a line of sight, or other ballistics trajectory parameters used to make an aiming adjustment in order to hit a target at a given range.

Aiming adjustments are designated in terms of inches or centimeters at the target range. Another way to designate vertical aiming adjustment is in terms of minutes of angle (MOA). For example, most riflescopes include adjustment knob mechanisms that facilitate mechanical elevation adjustments in ¼ MOA or ½ MOA increments. Accordingly, ballistic software may output as ballistic solutions aiming adjustment amounts (i.e., projectile drop or path) in terms of MOA or distance (height in inches). The ballistic solution may include vertical aiming adjustments and horizontal aiming adjustments.

The vertical aiming adjustments, also called elevation adjustments, are typically established by holdover and holdunder adjustments (also referred to as come-up and come-down adjustments) or mechanical elevation adjustment to a riflescope or other aiming device (relative to the weapon on which the aiming device is mounted). Similarly, horizontal aiming adjustments are made by aiming to the left or right, or by mechanical adjustments, and are commonly referred to as windage adjustments.

Some ballistic software programs have been adapted to operate on a handheld computer. For example, U.S. Pat. No. 6,516,699 of Sammut et al. describes a personal digital assistant (PDA) running an exterior ballistics software program. Other ballistic software programs are deployed in laser rangefinder binoculars and projectile-weapon aiming systems rigidly affixed to a weapon and commonly embodied as a riflescope. Riflescopes include reticles for aiming at locations indicated by a reticle aiming mark. A reticle aiming mark defines an aiming point at which a straight aiming line of sight intersects at a discrete distance a bullet's or other projectile's curved trajectory.

SUMMARY OF THE DISCLOSURE

Following the brief description of the drawing figures, this disclosure includes four subsections. The first subsection describes techniques for determining an aiming adjustment amount, both vertical and horizontal adjustment amounts, to shoot a target at a target range by iteratively solving for the projectile trajectory (e.g., projectile drop or path and deflection) such that the iteratively calculated projectile trajectory is determined to pass through the target location within a predetermined threshold amount (e.g., at a projectile path calculation of about zero). The second subsection describes techniques for indicating whether a projectile has supersonic, transonic, or subsonic speed at a given range. The third subsection describes a real-time ballistic system (RTBS) that allows a shooter to obtain ballistic solutions with multiple bullet weights without re-sight-in (re-zero). This feature allows a shooter having a rangefinder, range-finding riflescope, or spotting scope with the feature to readily obtain optimum elevation and windage adjustments for a first ammunition that are relative to ballistic calculations obtained from a first ammunition information (e.g., bullet weight) used during a sight-in (zero) process. The fourth subsection describes techniques similar to those of the first subsection, but for iteratively determining an aiming adjustment amount (referred to simply as an aiming adjustment) that also compensates for a moving target.

Additional aspects and advantages will be apparent from the following detailed description of preferred embodiments, which proceeds with reference to the accompanying drawing figures.

BRIEF DESCRIPTION OF THE DRAWINGS

For purposes of illustration, certain details of the drawing figures, such as, for example, trajectory curves and angles between various lines, are greatly exaggerated and not to scale.

DETAILED DESCRIPTION OF EMBODIMENTS

I. Aiming Adjustment by Iteration of Ballistics Trajectory Parameters

Initially, this first section of the disclosure explains how the present inventors recognized that existing ballistics software inaccurately assumes that an aiming adjustment that should be applied at a given range is equivalent to the projectile path calculation at that range. In short, the present inventors surmised that this inaccurate assumption is premised on at least two sources of error.

First, applying the foregoing aiming adjustment ignores the fact that an adjusted trajectory established by the aiming adjustment subjects a bullet traveling along that trajectory to gravitational and barometric effects that are different from those of a trajectory calibrated as passing through the true zero. In other words, the adjusted trajectory will result in a trajectory that is different in length and angle from that of a baseline trajectory calibrated for (zeroed at) a preselected, true zero range.

Figure 1:
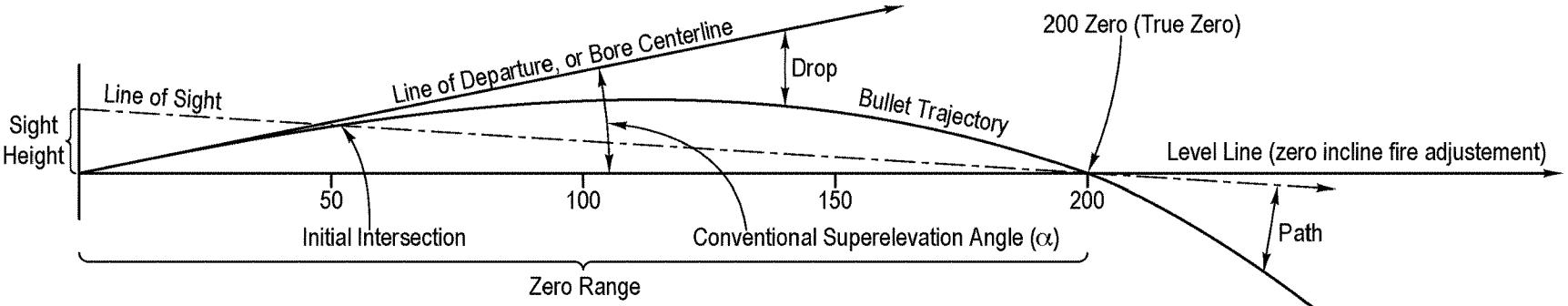
Fig. 1 (PRIOR ART)
FIG. 1 is a bullet trajectory diagram showing a conventional model of a level-fire bullet trajectory, according to a prior art embodiment.

Second, the foregoing aiming adjustment inaccurately assumes an angle between a bore centerline and line to a target, which is called a superelevation angle $\alpha$ (FIG. 1), is the same for a target located at the true zero or at another range different from the true zero.

Figure 2:
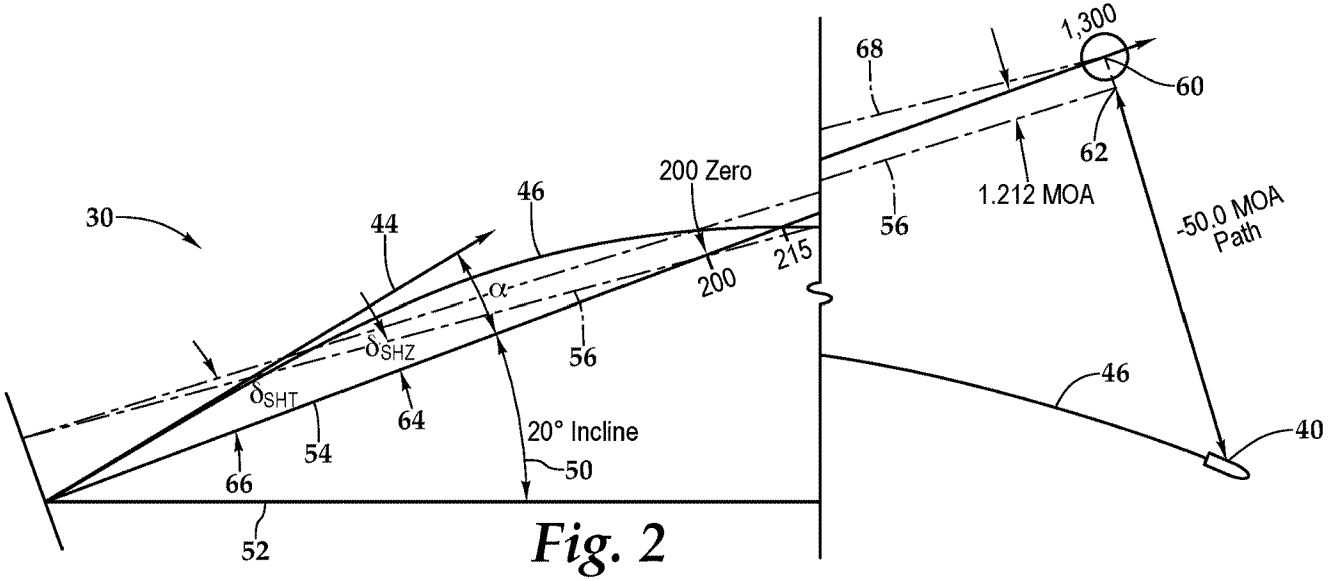
FIG. 2 is a bullet trajectory diagram showing a calculated 20° inclined-fire bullet trajectory, and showing in a right-side fragmentary detail a bullet path MOA calculation of −50.0 MOA as measured from a target positioned at a 1,300-yard line-of-sight range.
Figure 3:
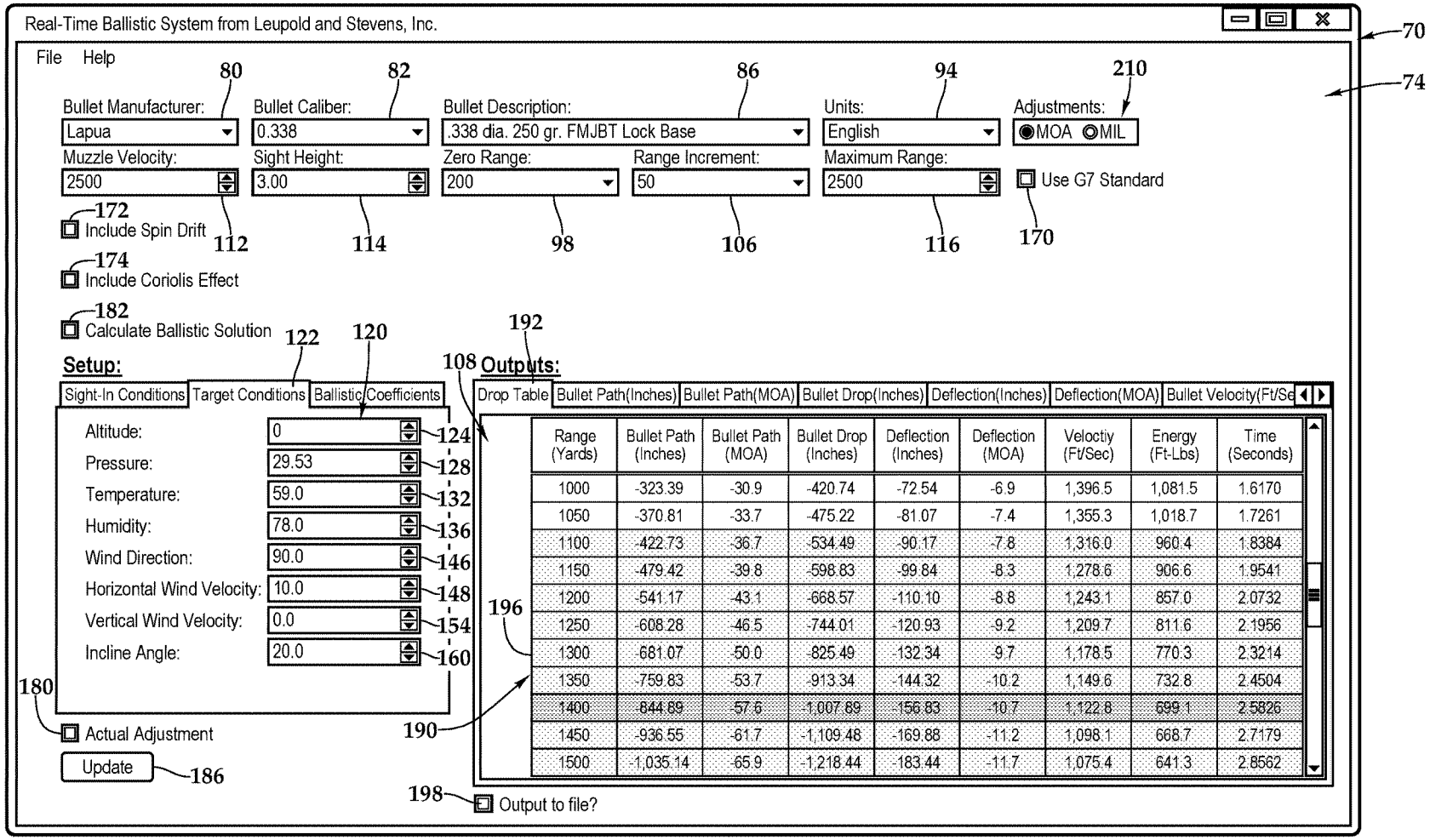
FIG. 3 is a screen image capture of a real-time ballistics system software user interface including an output display section tab entitled "Drop Table" that is presenting ballistic calculations output in a drop table (also called a trajectory table) having table rows of 50-yard increments representing in numeric form from 1,000 to 1,500 yards the calculated 20° inclined-fire bullet trajectory of FIG. 2, the rows having background colors indicating ranges at which a bullet would have transonic or subsonic speed.
Figure 4:
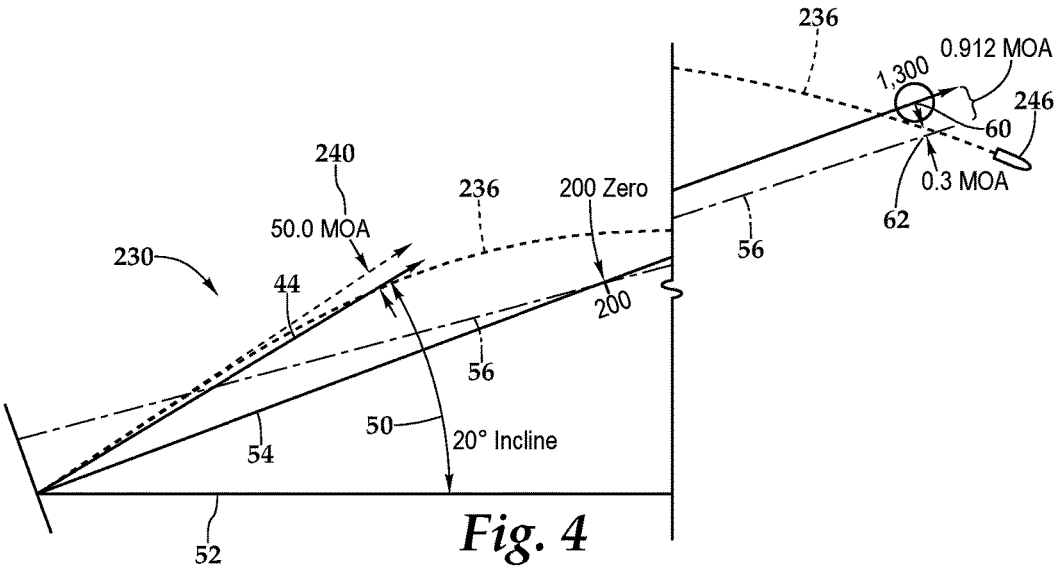
FIG. 4 is a bullet trajectory diagram showing in dashed lines an adjusted bullet trajectory that is a recalculated version of the bullet trajectory of FIG. 2, after incorporating a 50.0 MOA conventional elevation aiming adjustment for compensating for the bullet path MOA calculation of FIGS. 2 and 3, and showing in a right-side fragmentary detail that a bullet actually fired according to the conventional elevation aiming adjustment would undershoot the target positioned at the 1,300-yard range.
Figure 5:
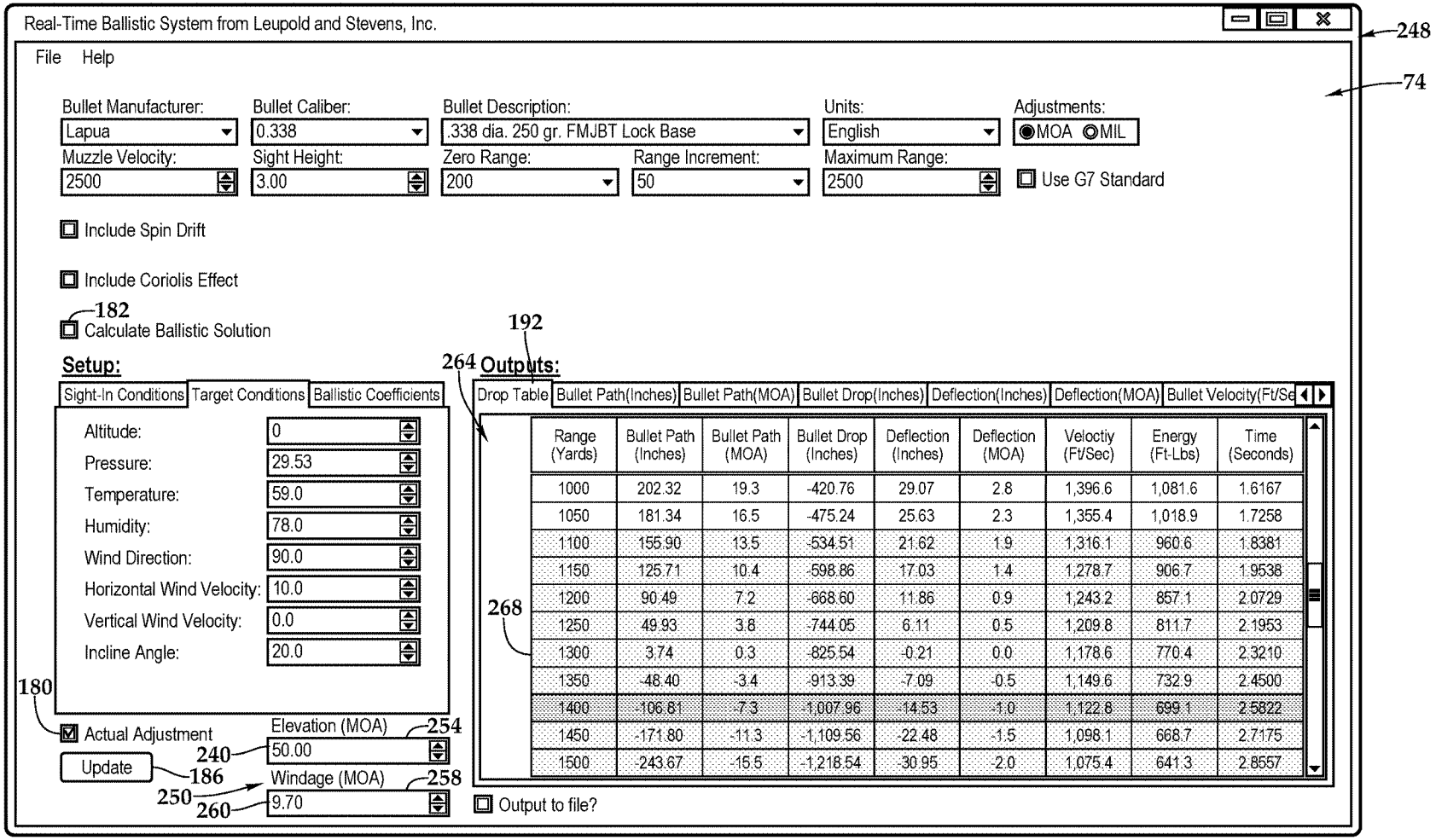
FIG. 5 is a screen image capture of the real-time ballistics system software user interface of FIG. 3, showing the recalculated version of the bullet trajectory of FIG. 2 in the form of a drop table, in which the drop table shows a calculated (i.e., virtual) overshoot expressed as a bullet path MOA calculation of 0.3 MOA (3.74 inches).

The two sources of error are explained by an example calculated 20° inclined-fire bullet trajectory of FIGS. 2 and 3, which show the example calculated 20° inclined-fire bullet trajectory in the forms of, respectively, a bullet trajectory diagram and a bullet drop table. Before explaining the information shown in these drawing figures, it is important to clarify that they show a calculated trajectory—they do not show an actual measured trajectory. Consequently, these two drawing figures, as well as FIGS. 4 and 5, depict the two sources of error noted in the previous paragraph, which would not be present in an actual measured trajectory represented by FIGS. 7 and 10.

Specifically, FIG. 2 shows a bullet trajectory diagram 30 that depicts a bullet 40 calculated as exiting from a weapon bore (not shown) along a line of departure 44 so as to travel along a calculated bullet trajectory 46. The a line of departure 44 is at the superelevation angle $\alpha$ and is inclined by a 20° incline angle 50 between a horizontal level line 52 and an incline target position line 54 extending through the 200-yard zero that is intersected by a line of sight 56.

Below a target 60, at a virtual target location 62 along the line of sight 56 at a line-of-sight range of 1,300 yards away from the weapon, the bullet trajectory 46 is characterized by a bullet path calculation of −50.0 MOA. A 50.0 MOA aiming adjustment, however, is not the correct aiming adjustment to apply for shooting because, as described in later examples, such an aiming adjustment produces a new trajectory having environmental effects that are not accounted for in the trajectory 46. Ignoring the change in environmental effects results in the first source of error.

The second source of error is typically less pernicious in its effect on shooting accuracy. Still, for improved accuracy, suffice it to say that some embodiments also address this second source of error, which is summarized as follows. It is noted that the aforementioned calculations are based on the virtual line of sight 56 intersecting the 200-yard zero along the incline target position line 54. But a target may not be (and frequently is not) located at the 200-yard zero. In fact, in the example of FIGS. 2 and 3, the target 60 along the incline target position line 54 is located 1,300 yards away from the weapon. The −50.0 MOA bullet path calculation, however, is not actually calculated from the target 60 because a bullet path parameter is, by definition, calculated relative to a line of sight. This is why the −50.0 MOA is shown in FIG. 2 as being calculated relative to the virtual target location 62 along the virtual line of sight 56. In other words, the location 62 is actually 1.212 MOA below an actual location of the target 60. This means that the superelevation angle $\alpha$ used in conventional ballistics calculators does not account for changes in an actual line of sight and bore position that occur when aiming at targets that are not located at the true zero. An actual superelevation angle for a bullet hitting the target 60 at a range of 1,300 yards, however, is a function of a difference of a zeroed sight-height depression angle 64 ($\delta_{SHZ}$) and a target sight-height depression angle 66 ($\delta_{SHT}$). As described in later examples, the zeroed sight-height depression angle ($\delta_{SHZ}$) 64 is the angle between the incline target position line 54 and the line of sight 56; the target sight-height depression angle ($\delta_{SHT}$) 66 is the angle between the incline target position line 54 and an actual line of sight 68 to the target 60. These later examples explain that the actual superelevation angle is iteratively adjusted for determining aiming adjustments for aiming at targets that may be inclined or at different ranges from the true zero.

FIG. 3 also shows the aforementioned bullet trajectory information, but in the numeric form of a bullet drop table presented in a screen image capture 70 of a real-time ballistics system software user interface 74. The input menus of the user interface 74 are explained in the following paragraphs, which are followed by a discussion of the ballistic calculations output, produced by the software, based on ballistics calculation input parameters entered into the input menus.

The user interface 74 has six drop-down combo box menus including a Bullet Manufacturer menu 80, a Bullet Caliber menu 82, and a Bullet Description menu 86 showing that the type of the bullet 40 (FIG. 2) is a .338 Lapua full metal jacket boat tail (FMJBT) available from Nammo Lapua Oy of Raufoss, Norway. In some embodiments, these drop-down combo box menus can be modified by a user so as to select another predefined ammunition type or to develop a custom ammunition type. Other drop-down combo box menus include a Units menu 94 to select English or metric units, a Zero Range menu 98 to select the true zero, and a Range Increment menu 106 to select the distance between rows of a drop table 108.

In addition, the user interface 74 includes several so-called spinner menus used to allow a user to input weapon configuration values and then increment or decrement the values. These spinner menus include a Muzzle Velocity menu 112, a Sight Height menu 114, and a Maximum Range menu 116 that defines a limit to the number of rows presented in the drop table 108. Another set of spinner menus 120 is shown in a menu tab 122 entitled "Target Conditions." These spinner menus 120 include menus to configure the ballistics calculator algorithms with additional input data characterizing conditions at the target location. Identical spinner menus (FIG. 12) are available for characterizing "Sight-In Conditions" at the sight-in location.

The spinner menus 120 include an Altitude menu 124, a Pressure menu 128 to configure the barometric pressure, a Temperature menu 132, a Humidity menu 136, a Wind (horizontal) Direction menu 146 that allows a user to enter in degrees a horizontal direction of wind, a Horizontal Wind Velocity menu 148 for the speed of the horizontal wind, a Vertical Wind Velocity menu 154 for positive (updraft) or negative (downdraft) value of vertical wind speed, and an Incline Angle menu 160 showing that a user has input the value of the 20° incline angle 50 (FIG. 2) discussed previously.

The user interface 74 also has five checkbox menus. A Use G7 Standard checkbox 170 allows a user to select whether the ballistics calculations are based on a G7 ballistic coefficient model or a predecessor model. An Include Spin Drift checkbox 172 and Include Coriolis Effect checkbox 174 allow a user to select whether spin drift and coriolis effects are included as factors in the ballistics calculations. An Actual Adjustment checkbox 180 allows a user to input horizontal and vertical aiming adjustments that were already intended to be made. For example, as explained later with reference to FIG. 5, the checkbox 180 may be used whenever a user has deployed preexisting (i.e., mechanical) riflescope adjustments for windage and elevation. Finally, a Calculate Ballistic Solution checkbox 182 allows a user to select whether the ballistics calculations also provide as an output a ballistic solution aiming adjustment that the user can then use to adjust his or her aim and hit a target at a predetermined range. An iterative technique for computing the solution is the subject of this subsection and is explained in detail in subsequent paragraphs.

Once a user has input his or her desired input parameters, the user clicks on an Update button 186 to initiate a ballistics calculation and to refresh ballistics calculations output 190 presented in a Drop Table menu tab 192. In another embodiment, the output 190 of a Drop Table menu tab 192 may simply update automatically anytime a change is made to any input, i.e., without having the user actuate the Update button 186. This automatic update feature is also applicable to other ballistics calculator embodiments, such as, for example, a rangefinder that includes a computing device for automatically calculating ballistics solutions in response to dynamic ranging measurements or varying environmental and target measurement inputs. For purposes of this disclosure, such automatic updates of ballistics solutions are also referred to as real-time ballistics solutions.

The ballistics calculations output 190 shows in numeric form the bullet trajectory 46 of FIG. 2. For example, in a row 196 beginning with "1300," which represents the trajectory 46 at the location of the target 60 (FIG. 2), a Bullet Path calculation is −681.07 inches or −50.0 MOA; a Bullet Drop calculation is −825.49 inches; a Deflection calculation is −132.34 inches or −9.7 MOA; a Velocity calculation is 1,178.5 feet per second (ft/sec); an Energy calculation is 770.3 foot-pounds (ft-lbs); and a Time (of flight) calculation is 2.3214 seconds.

Data of the drop table 108 can be exported to a file by checking checkbox 198.

As an aside, it is noted that an Adjustments radio button menu set 210 is also included as a component of the user interface 74. The menu set 210 allows a user to select whether iteratively calculated ballistics solutions are output in terms of MOA or MIL. These solutions are not shown in FIG. 3 because the checkbox 182 is not checked. Therefore, a discussion of these solutions is provided later in this disclosure with reference to FIG. 10.

FIGS. 4 and 5 depict an example of how ballistics calculators are used to develop a conventional aiming adjustment. For example, after obtaining the −50.0 MOA bullet path adjustment shown in FIGS. 2 and 3, a user would typically holdover or make a mechanical elevation adjustment of 50.0 MOA. Such an adjustment effectively presumes that an adjusted bullet trajectory still passes through the true zero (more precisely, the true zero along a slant range for inclined shots), which perforce ignores the fact that the adjustment establishes a new, adjusted bullet trajectory. This assumption does not account for environmental and gravitational effects imparted on a bullet traveling along the adjusted bullet trajectory. Thus, as stated previously, the present inventors surmised that such an adjustment would actually result in the bullet missing the target because the bullet travels along the adjusted bullet trajectory and therefore is subjected to different gravitational effects and other environmental effects compared to those affecting the bullet 40 traveling along the trajectory 46. To illustrate this point, FIGS. 4 and 5 show the prophetic results of a conventional adjustment, as depicted in the forms of, respectively, a bullet trajectory diagram and a bullet drop table.

FIG. 4 shows a bullet trajectory diagram 230 including, in dashed lines, an adjusted bullet trajectory 236 established by adjusting the angle of the line of departure 44 of FIG. 2 (shown in solid lines) by a 50.0 MOA elevation adjustment 240 so as to compensate for the −50.0 MOA bullet path calculation of FIGS. 2 and 3. A right-side fragmentary detail also shows that the conventional aiming elevation adjustment causes a projectile 246 traveling along the adjusted bullet trajectory 236 to overshoot the virtual target 62 at the 1,300-yard range. The exact calculations of the clear miss shown in FIG. 4 are set forth in a row 268 of FIG. 5, explained as follows.

FIG. 5 is a screen image capture 248 of the real-time ballistics system software user interface 74 of FIG. 3, but including user input 250 to the Actual Adjustment checkbox 180. Checking the Actual Adjustment checkbox 180 causes the user interface 74 to present two additional spinner menus. An Elevation (MOA) menu 254 allows a user to input the 50.0 MOA elevation adjustment 240 (FIG. 4), or other vertical aiming adjustment used for ballistics calculations. Similarly, a Windage (MOA) menu 258 allows a user to input a windage adjustment 260, or other horizontal aiming adjustment. In the example shown in FIG. 5, the windage adjustment 260 entered into the Windage (MOA) menu 258 is 9.7 MOA, which is intended to compensate for the −9.7 MOA Deflection calculation in the row 196 of FIG. 3. Once these aiming adjustments are entered via the spinner menus, the user may actuate the Update button 186 to recalculate output 264 presented in a Drop Table menu tab 192. The output 264 shows that the calculated overshoot of FIG. 4 is 0.3 MOA (3.74 inches), as shown in the row 268 calculations of the bullet trajectory 236 passing by the virtual target 62 positioned at the 1,300-yard range.

Figure 6:
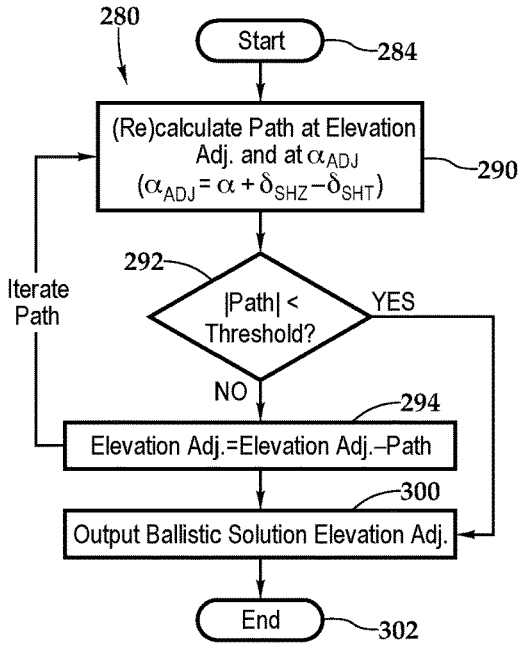
FIG. 6 is a flowchart of a method for a ballistics calculator to determine an aiming elevation adjustment amount for shooting a target at range by iterating a calculated ballistics solution elevation adjustment until a bullet path calculation is less than a desired threshold at the range.

To compensate for the aforementioned overshoot, the present inventors developed a method 280 shown in a flowchart in FIG. 6. Generally, the method 280 iterates a calculated ballistics solution elevation adjustment until a bullet path calculation is less than a desired threshold at the range. Each iteration is analogous to an actual reference shot taken by a shooter in that the iterations model the application of real-world aiming adjustments that modify superelevation angle, produce a change in environmental effects, and, ultimately, change a projectile's trajectory.

At a start 284 of the method 280, a user or input device establishes the initial ballistic and target conditions, such as, for example, the ballistic and target inputs described previously with reference to FIG. 3. These initial inputs are used to calculate an initial elevation adjustment amount (e.g., the aforementioned 50.0 MOA adjustment) and to initialize an iteratively adjusted superelevation angle $\alpha_{ADJ}$ as being equal to the zeroed superelevation angle $\alpha$. Additionally, the user or input device (e.g., a laser rangefinder) inputs a range to a target.

The method 280 then proceeds to calculating 290 a bullet path for the desired range, according to the initial elevation adjustment. For example, FIG. 5 shows that the calculated bullet path at the 50.0 MOA adjustment is a 0.3 MOA overshoot.

The method 280 proceeds to determining 292 whether the absolute value of the bullet path is less than a predetermined threshold. For example, a user may seek to have less than a +/−0.01 MOA error in terms of overshoot or undershoot.

When 0.3 MOA is not less than the desired threshold, the method 280 proceeds to updating 294 the initial elevation adjustment. The updating 294 includes setting an elevation adjustment as being equal to the current (e.g., initial) elevation adjustment minus the current bullet path calculation from the calculation 292. For example, in a first pass of the method 280, the updating 294 would result in the current elevation adjustment being 50.0 MOA minus 0.3 MOA, which is 49.7 MOA.

With a new elevation adjustment being calculated, the method 280 proceeds to recalculating 290 the bullet path at the new elevation adjustment amount and the iteratively adjusted superelevation angle $\alpha_{ADJ}$, which is adjusted according to the following equation:

$$\alpha_{ADJ}=\alpha+\delta_{SHZ}-\delta_{SHT}$$

In some embodiments, the Elevation (MOA) menu 254 of FIG. 5 may be manually or automatically updated to change from the 50.0 MOA adjustment amount to the 49.7 MOA adjustment amount, and the output 264 would be recalculated. Assuming it were recalculated, the new output would show a calculated bullet path that is slightly negative (i.e., an undershoot), but the absolute value of this negative value would be less than the absolute value of the initial 0.3 MOA overshoot. In other words, the first iteration would reduce error resulting from the initial elevation adjustment of 50.0 MOA.

Figure 7:
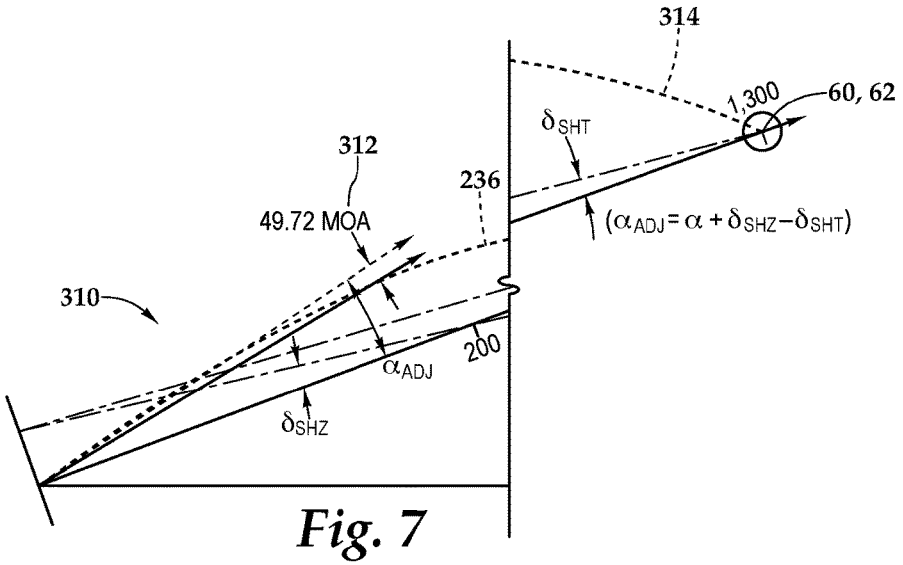
FIG. 7 is a bullet trajectory diagram showing in dashed lines an adjusted bullet trajectory established by aiming with a 49.72 MOA elevation adjustment amount obtained using the iterative method of FIG. 6 such that a projectile is shown hitting the target at the range of 1,300 yards.

Multiple passes of the bullet path iteration can be made so as to further reduce error to the point where it is below the desired +/−0.01 MOA error threshold. For example, once the iterative calculation of the bullet path converges toward zero, the bullet path may then be determined to be less than the predetermined threshold, at which point the method 280 proceeds to outputting 300 the iteratively calculated ballistic solution for the elevation adjustment, and the method 280 ends 302. A bullet trajectory diagram 310 of FIG. 7 shows one such output. An iteratively calculated elevation adjustment 312 is now shown to be 49.72 MOA. Accordingly, a bullet trajectory 314 now passes through the target 60.

The method 280 is an example iterative technique that reduces the value of the calculated bullet path until the value approaches zero. In other words, the iterative calculation effectively re-zeros the weapon so that the re-calculated zero point of the bullet trajectory falls upon the location of a target. However, there are other ballistics trajectory parameters that could also be used to achieve a similar result.

Noting that bullet path is but one ballistics trajectory parameter, other ballistics trajectory parameters may be iteratively calculated to develop a ballistic solution comparable to that of the method 280. For example, bullet drop could be iteratively calculated so that a change in the calculated ballistic drop between successive iterations is determined to be below a desired threshold amount. Once the change in ballistic drop stabilizes below a predetermined tolerance, the iteratively calculated ballistic drop may be used according to conventional ballistics and trigonometric calculations for converting the ballistic drop to a vertical aiming adjustment. For this reason, the phrase "iterative calculation of ballistic trajectories" means iterative calculation of any ballistics trajectory parameter defining a bullet's trajectory and used for purposes of developing an aiming adjustment. And an aiming adjustment generally refers to vertical aiming adjustments (e.g., elevation) and horizontal aiming adjustments (e.g., deflection).

Figure 8:
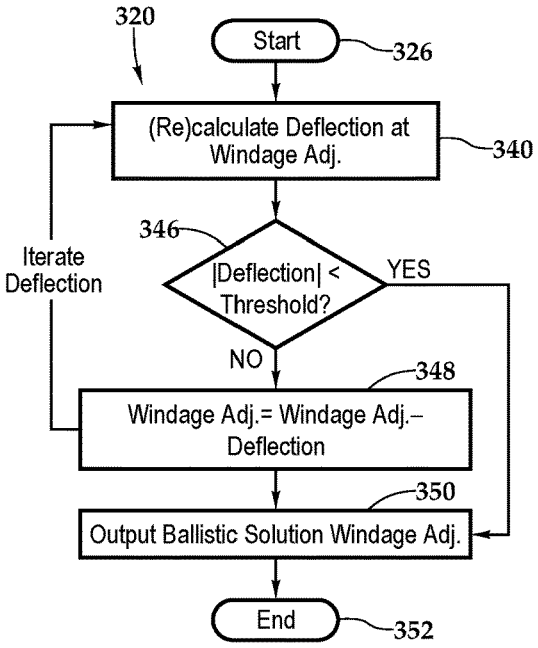
FIG. 8 is a flowchart of a method for a ballistics calculator to determine an aiming windage adjustment amount for shooting a target at range by iterating a calculated ballistics solution windage adjustment until a bullet deflection calculation is less than a desired threshold at the range.

Similar to the method 280, FIG. 8 shows a method 320 for a ballistics calculator to determine an aiming windage adjustment amount for shooting a target at range by iterating a calculated ballistics solution windage adjustment until a bullet deflection calculation is less than a desired threshold at the range. For conciseness, it suffices to say that the method 320 is analogous to the method 280, but instead of calculating for a parameter (i.e., bullet path or bullet drop) used to establish a vertical aiming adjustment amount, deflection is iteratively calculated by the method 320 to determine a horizontal aiming adjustment amount.

At a start 326 of the method 320, a user or input device establishes the initial target and ballistic conditions, as described for the start 284 of the method 280. These initial inputs are used to calculate an initial windage adjustment amount (e.g., 9.7 MOA to compensate for the −9.7 MOA deflection calculation of FIG. 3). Additionally, the user or input device (e.g., a laser rangefinder) inputs a range to a target.

The method 320 then proceeds to calculating 340 a bullet deflection for the desired range, according to the initial elevation adjustment. For example, FIG. 5 shows that the calculated bullet deflection at the 9.7 MOA adjustment would result in a −0.21 inch miss to the side of the target.

The method 320 proceeds to determining 346 whether the absolute value of the bullet deflection is less than a predetermined threshold. For example, a user may seek to have less than a +/−0.01 inch error.

When the absolute value of −0.21 inch is not less than the desired threshold, the method 320 proceeds to updating 348 the initial windage adjustment. The updating 348 includes setting a windage adjustment as being equal to the current (e.g., initial) windage adjustment minus the current bullet deflection calculation from the calculation 340. For example, in a first pass of the method 320, the updating 348 would result in the current windage adjustment being 9.7 MOA, which is 132.34 inches, minus the −0.21 inch miss.

With a new windage adjustment being calculated, the method 320 proceeds to recalculating 340 the bullet deflection at the new windage adjustment amount. For example, the Windage (MOA) menu 258 of FIG. 5 may be manually or automatically updated to change from the 9.7 MOA adjustment amount to the new windage adjustment amount, and the output 264 would be recomputed. Assuming it were recomputed, the new output would show a calculated bullet deflection that reduces the amount of the initial −0.21 inch miss. In other words, the first iteration would reduce error resulting from the initial windage adjustment of 9.7 MOA. And, depending on the desired threshold, multiple iterations would produce an output horizontal aiming adjustment of 9.72 MOA for outputting 350 and ending 352 the method 320.

Figure 9:
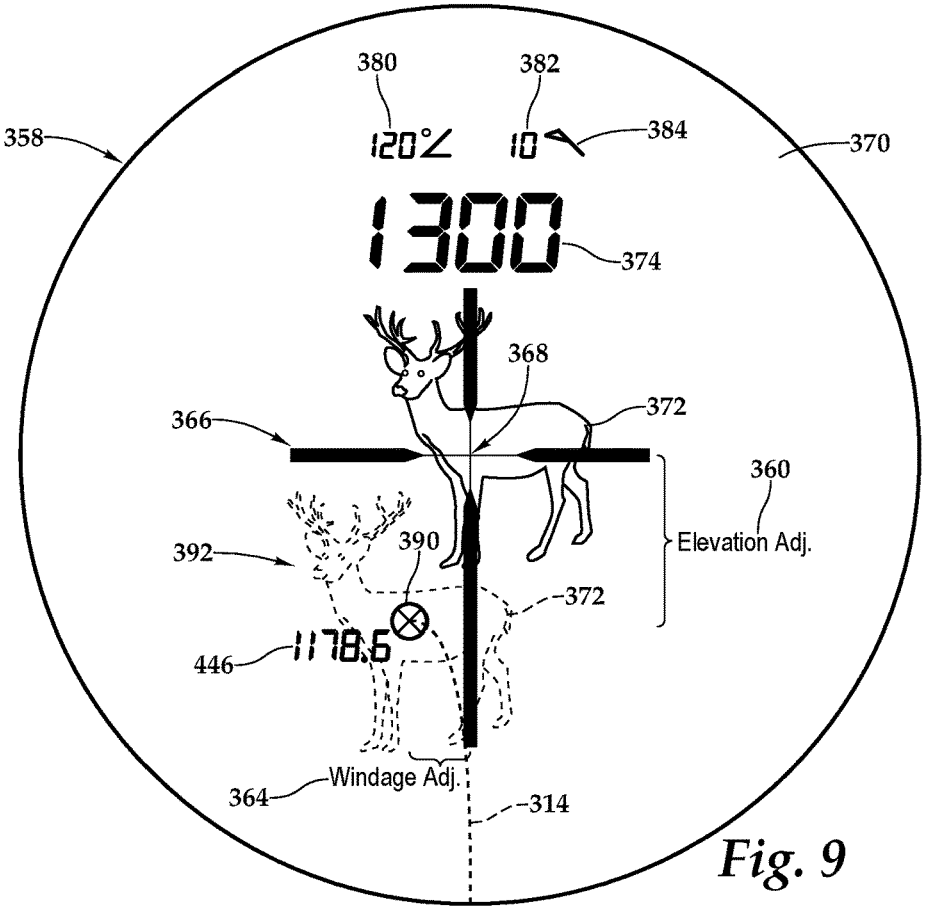
FIG. 9 is a view of a reticle as viewed through an ocular (eyepiece) of a laser rangefinder embodiment, annotated to show elevation and windage aiming adjustments for the bullet trajectory of FIG. 7.

Although the method 280 and the method 320 are described with reference to the ballistics software user interface of FIGS. 3 and 5, these methods need not be embodied in a desktop or laptop computer software application. The method 280 and the method 320 may be implemented according to other embodiments, including in a laser rangefinder binocular or rangefinding riflescope. For example, FIG. 9 is a view of a rangefinder reticle 358 as viewed through an ocular (eyepiece) of a laser rangefinder embodiment, in which the reticle 358 is annotated to show an elevation aiming adjustment amount 360 and a windage aiming adjustment amount 364 determined according to, respectively, the method 280 and the method 320.

The reticle 358 includes duplex-style vertical and horizontal crosshairs 366. A central crosshair aiming mark 368 provides an aiming point that indicates the location of a 200-yard true zero in a field of view 370. A user places the aiming mark 368 on a target 372 and presses a button (not shown) of the rangefinder to obtain a range measurement 374 to the target 372. The range measurement 374 of 1,300 yards is displayed above the crosshairs 366. Also displayed are an incline angle measurement 380 showing the 20° incline 50 of FIG. 2, a wind measurement 382 of 10 miles per hour, and a wind direction flag 384 indicating the direction of the wind.

Once the target 372 is ranged, a ballistics calculator within the rangefinder may automatically perform the method 280, the method 320, or both methods (e.g., in parallel) to obtain ballistics solutions for the elevation aiming adjustment amount 360 and the windage aiming adjustment amount 364. In response to determining these aiming adjustments, the rangefinder presents in the field of view 370 a relatively small aiming mark 390 that may be placed on the target 372 (as depicted by a dashed-line displaced view 392 of the target 372 produced by moving the reticle 358 relative to the field of view 370) so that when a bullet is fired toward the target 372 at an aiming point defined by the aiming mark 390, the bullet would travel along the trajectory 314 (see, e.g., FIG. 7) calculated by the ballistics calculator to intersect the target 372 at the measured range of 1,300 yards.

According to some embodiments, the position of the aiming mark 390 may be dynamically moved in real time as input information is gathered and modified by the user or input device. For example, a rangefinder, such as the one described in U.S. Pat. No. 7,654,029, which incorporated by reference herein in its entirety, may include various environmental and positional sensors, such as inclinometers, fiber optic gyroscopes, temperature sensors, and the like. (The '029 patent is assigned to Leupold and Stevens, Inc., which is also the assignee and applicant for the present application). These or other sensors may provide input that dynamically changes the ballistic solution in real time, and thereby updates the position of the aiming mark 390 in response to continuously changing input information.

Figure 10:
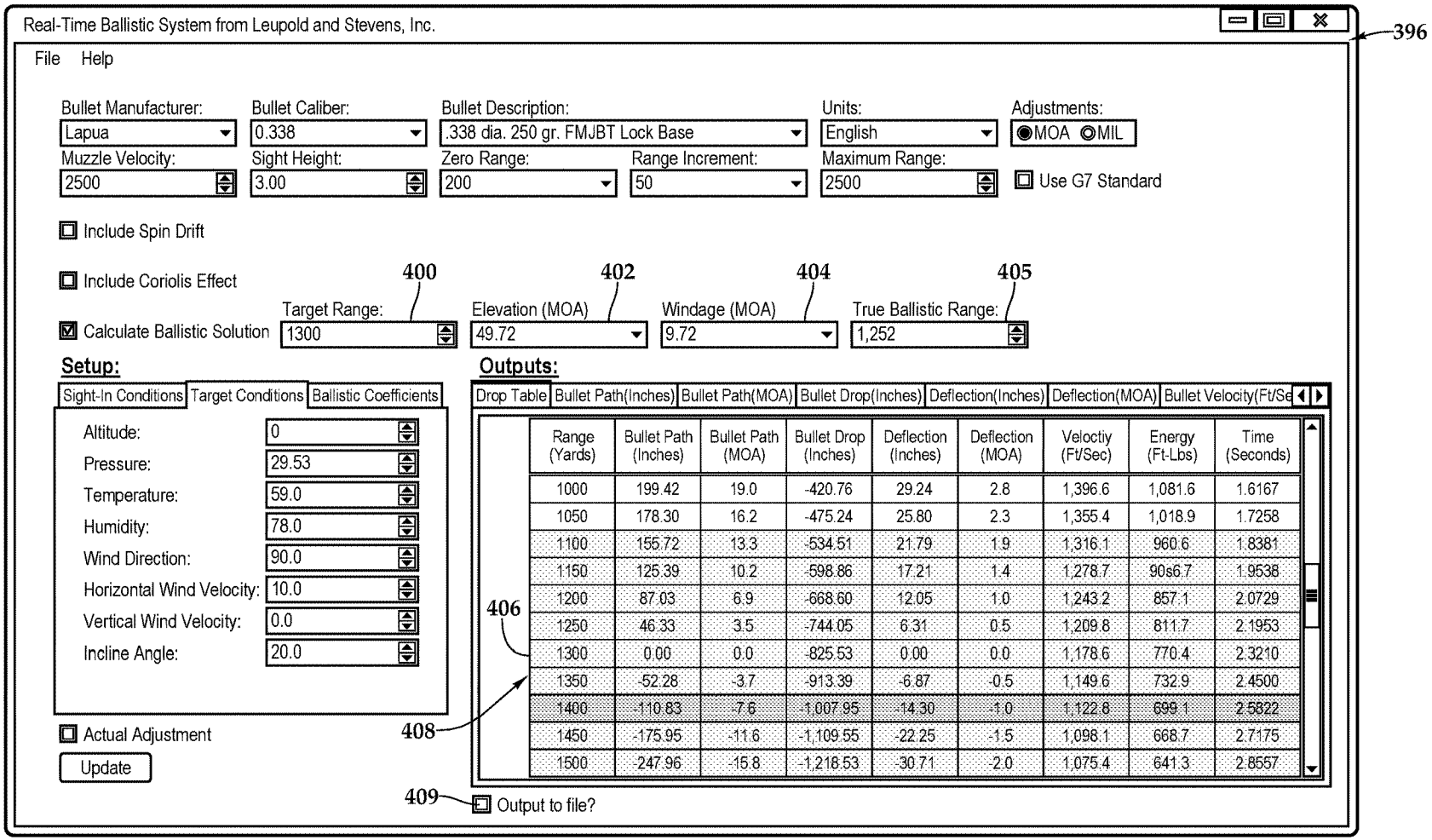
FIG. 10 is a screen image capture of the real-time ballistics system software user interface of FIG. 3 showing a drop table and calculated ballistic solution for elevation and windage aiming adjustments used to establish the bullet trajectory of FIG. 7.

FIG. 10 shows another embodiment of a ballistic software application user interface 396 outputting in numerical form (MOA) the elevation aiming adjustment amount 360 and the windage aiming adjustment amount 364 shown in FIG. 9. For example, the user interface 396 shows that a user has selected the Calculate Ballistic Solution checkbox 182 mentioned previously with reference to FIG. 5. The selection of the checkbox 182 causes the software to also present another spinner menu, which is a Target Range menu 400 that allows the user to input a predetermined range to a target. For example, in FIG. 10, the user has entered in the Target Range menu 400 the range measurement 374 (FIG. 9) of 1,300 yards. The selection of the checkbox 182 also causes the software to perform the methods 280 and 320 so as to present in an Elevation (MOA) field 402 and a Windage (MOA) field 404, respectively, an indication to a user of the iteratively calculated 49.72 MOA elevation and 9.72 MOA windage aiming adjustment amounts. A field 405 outputs a measure of true ballistic range (TBR), also known as equivalent horizontal range, as described in the incorporated '029 patent.

II. Supersonic, Transonic, or Subsonic Velocity Indications

In FIGS. 3, 5, and 10, table rows from "1100" yards to "1350" yards may be yellow in color to indicate that a bullet would be transitioning from supersonic speed (i.e., above about Mach 1.2, as calculated according to the target conditions of menu tab 122 (FIG. 3)) to subsonic speed (i.e., below about Mach 0.8, again at altitude). For example, FIG. 10 shows that a row 406 beginning with "1050" yards has a Velocity calculation of 1,355.4 ft/sec (Mach 1.21), which is supersonic. Therefore, this row may be shown in white. In contrast, a row 408 beginning with "1400" has a Velocity calculation of 1,122.8 ft/sec (Mach 1.00), which is a first row 408 at which a bullet is calculated to travel at subsonic air speeds. Therefore, this row may be red in color. The rows that follow the red-colored row may be yellow in color to indicate that the bullet, while still in the transonic range, would have diminishing flight stability. In other embodiments, various colors or graphical indicators may be used to express the supersonic, transonic, and subsonic velocity indications. For example, supersonic could be shown with green-colored rows or a supersonic icon depiction.

Figure 11:
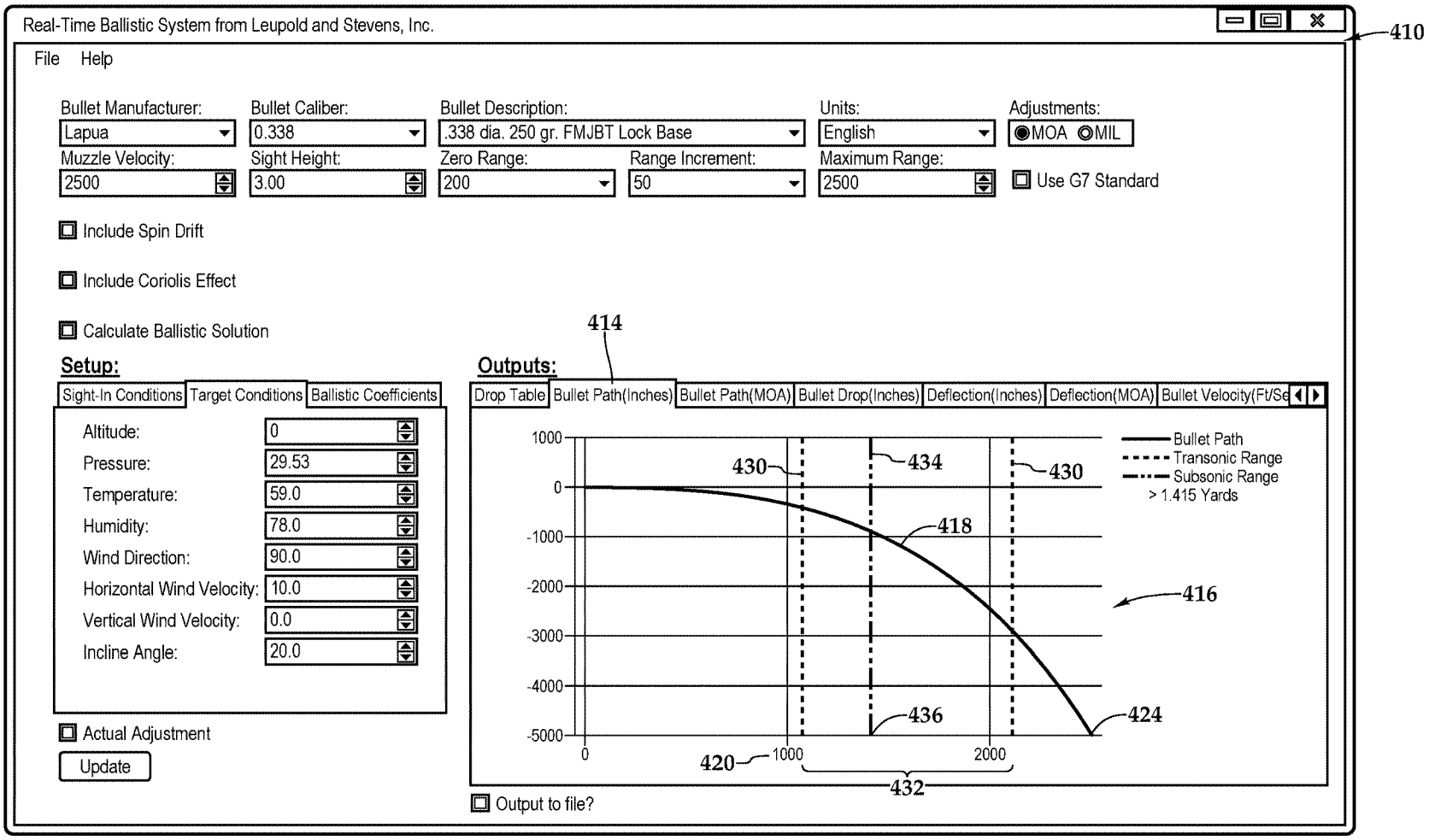
FIG. 11 is a screen image capture of the real-time ballistics system software user interface including an output display section tab entitled "Bullet Path (Inches)" with contents in the form of a graph plotting a bullet path at given ranges and indicating ranges at which a bullet's calculated velocity is determined to produce transonic air speeds, and a range at which the bullet's calculated velocity is determined to transition to a subsonic air speed.

According to another embodiment, FIG. 11 is a screen image capture 410 of the real-time ballistics system software user interface including an output display section tab 414 entitled "Bullet Path (Inches)" with contents in the form of a graph 416 plotting a calculated bullet path 418 versus increasing ranges 420 along an x-axis 424, and indicating with lines 430 (e.g., yellow lines) ranges 432 at which a bullet's calculated velocity is determined to produce transonic air speeds. The graph also indicates with a line 434 (e.g., a red colored line) a range 436 at which the bullet's calculated velocity is determined to transition to a subsonic air speed.

In another embodiment, the aiming mark 390 of FIG. 9 has displayed near its side a calculated velocity measurement 446 of a bullet at a calculated point of impact at the target 372. The velocity measurement 446 or aiming mark 390 is superimposed (e.g., rendered on a display) in the field of view 370 so that it may also be used to determine whether the bullet is transonic or supersonic. For example, the velocity measurement 446 or aiming mark 390 may be green to indicate supersonic, yellow to indicate a transition to transonic, and red to indicate an airspeed that is below subsonic. Other graphical icons or indicators are also within the scope of this disclosure.

III. Offset for Ballistics Calculations

Figure 12:
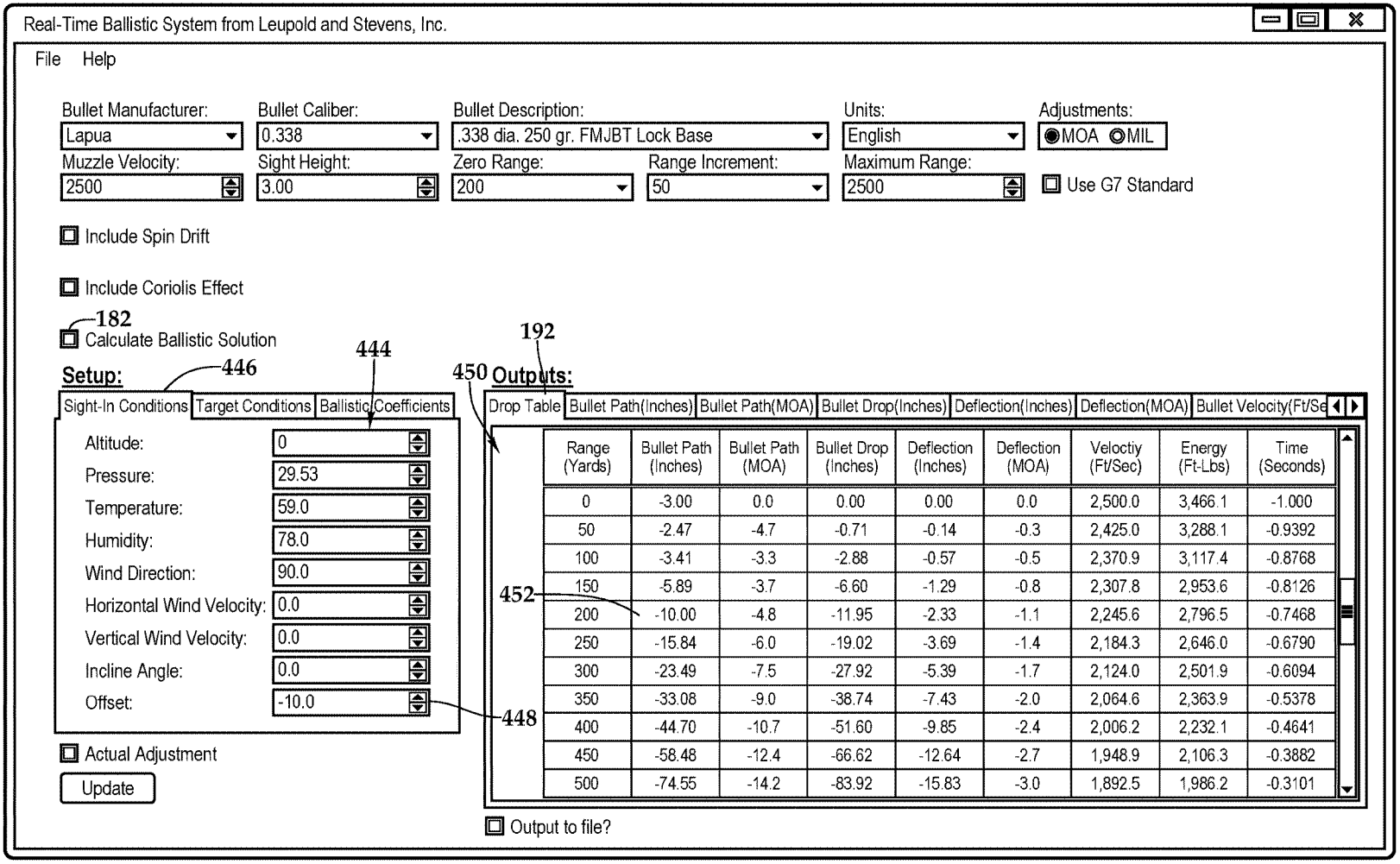
FIG. 12 is a screen image capture of the real-time ballistics system software user interface including an offset value entered as a sight-in condition.

FIG. 12 shows another set of spinner menus 444 in a menu tab 446 entitled "Sight-in Conditions." These spinner menus 444 include identical menus as those described previously with reference to FIG. 3. In addition, the menus 444 include an offset menu 448 that may be used to generate ballistic information for target loads relative to another load's superelevation angle. In other words, as explained by way of example deployment scenarios in the following five paragraphs, a sight-in offset value (e.g., a value entered in the menu 444) may be used to achieve one or more of the following: (1) allowing a user (e.g., a shooter) to setup a sight-in offset that occurs during a sight-in process of a new target load, in which the sight-in offset is relative to an original sight-in load; (2) allowing for independent selection between the sight-in load and the target load; (3) allowing the user to enter in a sight-in superelevation angle directly so as to bypass a sight-in process superelevation angle calculation of the RTBS algorithm; (4) allowing the user to bypass the sight-in process of the RTBS algorithm and re-use the previous superelevation angle found from and associated with a different load; or (5) allowing the user to perform a sight-in process at a target range that is different from a desired true-zero range.

In some embodiments, a shooter may configure ballistics information for the sight-in process independently from the ballistics information used during target calculations, e.g., when the sight-in load is different from a current load being used during target calculations. In such a case, the shooter may simply enter an offset amount into the offset menu 448 of the menu tab 446, which is then used to generate ballistics calculations output 450 presented in the Drop Table menu tab 192. Accordingly, a bullet path 452 at 200 yards (i.e., the true zero) is shown as being 10 inches below the true zero. The ballistics calculations output 450 thereby provides reference points of an actual bullet path at various other ranges, in which the reference points are shown relative to an original bullet load used during a sight-in process.

According to another embodiment, a shooter may want to sight-in their weapon using one cartridge, but then want to shoot another cartridge without re-zeroing (sighting-in) for that new cartridge. For example, some hunters use multiple bullet loads (usually of the same caliber but having different bullet weights) without re-zeroing after they switch between loads. Also, some users of Leupold and Stevens, Inc.'s Custom Dial Systems (CDS) may carry multiple CDS dials that are each developed for a particular load of ammunition. When a user does not know an actual offset (e.g., in inches of bullet path) between the two different bullets, but the user does know specific differences in the ballistics information (e.g., increased bullet weight), the user can simply specify those differences into a ballistics system to receive ballistics calculations for the bullet information used during target calculations. This implementation is particularly useful in a rangefinder, range-finding riflescope, spotting scope, or other ranging devices because a shooter will receive, for example, holdover or holdunder adjustment information relative to the sight-in load. In some embodiments, the user may elect to carry one CDS dial because the ballistics calculations would account for relevant offsets between the CDS (sight-in) load and the load actually being fired.

In some other embodiments, the shooter may seek to override an automatic sight-in process by entering an actual super-elevation angle to be used during the process that calculates a ballistic solution. Again, this override may be used when bullet information of the load being fired is different from that of load used during the sight-in process.

In yet other embodiments, the shooter may seek to override the automatic sight-in process by selecting whether the superelevation angle is to be computed. In other words, during the ordinary automatic sight-in process, a superelevation angle is computed. But by bypassing that calculation, a previously calculated angle would be used instead. This is useful because an angle from a previous load would be applied to the calculations for the current target load.

In another use case, a shooter does not have a true-zero target available (e.g., a target located at a 200-yard true zero) by which to sight-in ("zero") their weapon, but the shooter does have a target available at another range (e.g., a 100-yard range) and knows how much offset occurs at the available target range. Once the shooter knows an amount of offset that occurs at the available target range, the user may enter this amount into the offset menu 448 of the menu tab 446, which is then used to generate ballistics calculations output showing a bullet path that still intersects the true zero, even though a target at the true-zero range is not available.

IV. Aiming Adjustment for a Moving Target

The method 280 and the method 320 may be modified, according to some embodiments, so as to also factor in three-dimensional movements of a target. Before describing specifics of an example method (FIG. 14) that factors in three-dimensional movements, a description of an example applying the method is set forth with reference to FIG. 13.

Figure 13:
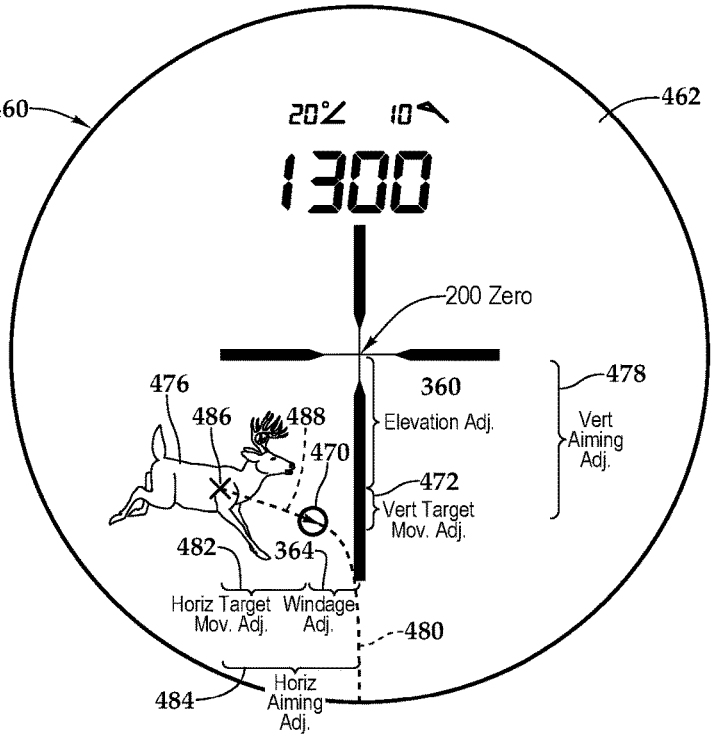
FIG. 13 is the view of the reticle of FIG. 9, incorporating horizontal and vertical target movement adjustments for a moving target.
Figure 14:
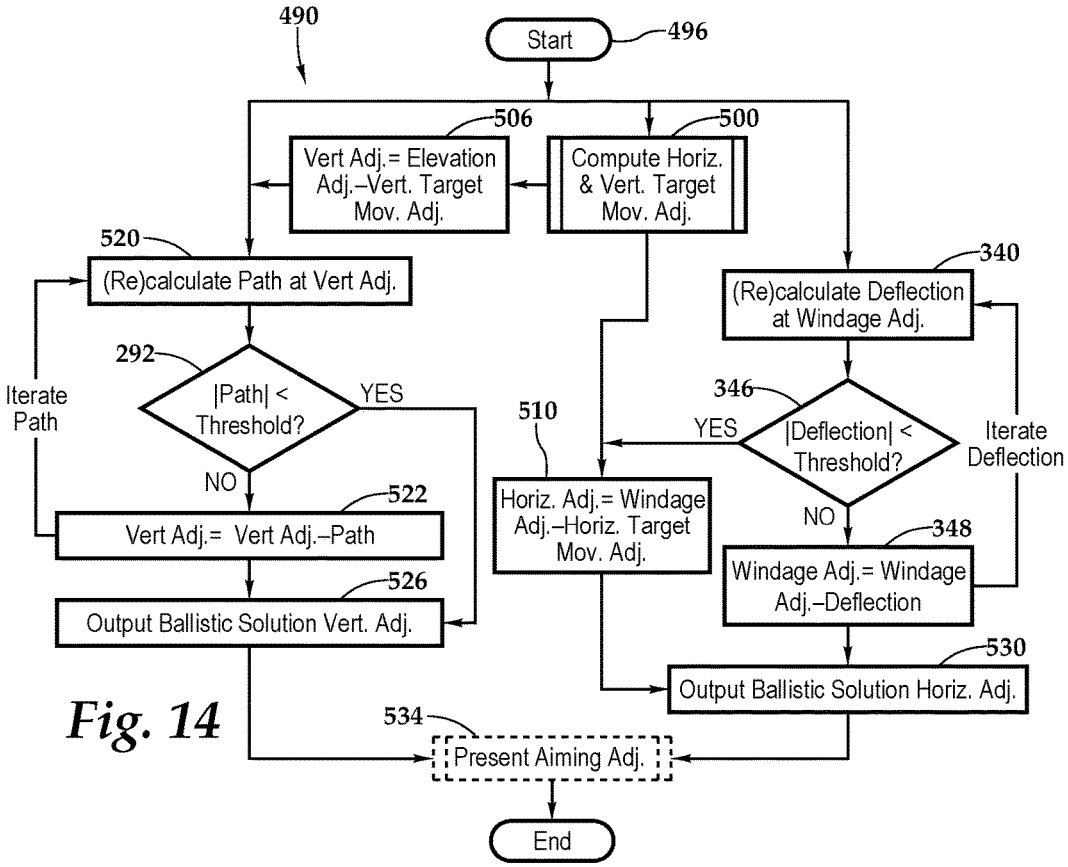
FIG. 14 is a flow diagram of a method for determining horizontal and vertical aiming adjustments for a moving target by iterative calculation of bullet trajectories.

FIG. 13 shows the aforementioned method deployed in the context of a rangefinding riflescope reticle 460. The reticle 460 is similar to the one shown in FIG. 7, but the aiming mark 390 of FIG. 7 is now shown in FIG. 13 as including two spaced-apart aiming mark components. These components are dynamically superimposed in a field of view 462 encompassed by the reticle 460, as explained in the following paragraphs.

A first circular component 470 indicates where a bullet is calculated to land, provided that the bullet is fired according to an aiming adjustment that includes elevation and windage aiming adjustments described previously with reference to FIGS. 6-10, and also provided that the aiming adjustment includes a vertical target movement adjustment 472. The vertical target movement adjustment 472 compensates for predicted movement of a target 476, in which the predicted movement is estimated to occur between the time a bullet is fired and the time that it arrives at the moving target 476. Because the target 476 may be moving with respect to a shooter in terms of both range and elevation, the movement would necessitate that the shooter further adjust his or her vertical aiming adjustment amount 478 by an amount indicated by the vertical target movement adjustment 472 so as to cause the fired bullet to traverse a new bullet trajectory 480. Thus, the vertical target movement adjustment 472 is factored into the position of the first circular component 470 in a field of view 462 encompassed by the reticle 460.

In contrast, a horizontal target movement adjustment 482 is not factored into the position of the first circular component 470. This is so because, unlike the vertical target movement adjustment 472, horizontal movement of the target 476 would not cause a bullet to experience changes in air density or gravitational effects. Horizontal movements of the target 476, however, are factored into a horizontal aiming adjustment 484 and the position of a second x-shaped component 486, as explained as follows.

The second x-shaped component 486 is offset from the first circular component 470 by a horizontal amount representing the horizontal target movement adjustment 482 and by a vertical amount that compensates for (i.e., backs out or reverses the effect of) the vertical target movement adjustment 472. Accordingly, the position of the second x-shaped component 486 can be used as an aiming mark that compensates for movement of a target 476. Thus, a shooter can place the second x-shaped component 486 on the target 476, shoot, and expect that the target 476 will thereafter move into the bullet's trajectory 478 by the time that the fired bullet arrives at the location indicated by the first component 470. A shooter, therefore, uses the position of the second x-shaped component 486 for hitting the moving target 476 with a bullet. This feature is similar to the one described previously for FIG. 9, but in the example of FIG. 9, the aiming mark 390 components are not offset from each other because the target 372 is stationary, whereas the target 476 is moving in the direction indicated by a dashed line 488.

Determining the location for placement of the components 470 and 486 is the subject of FIG. 13. FIG. 13 is a flowchart showing a sequence of process elements as rectangular-shaped blocks, decision elements as diamond-shaped blocks, and sets-of-processes (i.e., a so-called subprocess) elements as rectangular-shaped blocks having sidebars. The flowchart illustrates a method 490 for determining vertical and horizontal aiming adjustment amounts for a moving target by iterative calculation of bullet trajectories. In other words, the method 490 builds on concepts described in the contexts of the method 280 (elevation adjustment) and the method 320 (windage adjustment). In addition, the method 490 includes techniques for compensating for movement of the target 476. Accordingly, the far left-hand side of FIG. 14 generally corresponds to FIG. 6, the far right-hand side of FIG. 14 generally corresponds to FIG. 8, and the middle portion of FIG. 14 includes additional components of the method 490 that are used for compensation of target motion described in FIG. 13.

At a start 496 of the method 490, a user or input device establishes the initial ballistic and target conditions, such as, for example, the ballistic and target inputs described previously with reference to FIG. 3, to produce an initial elevation adjustment amount (e.g., the aforementioned 50.0 MOA adjustment) and an initial windage adjustment amount (e.g., the aforementioned 9.7 MOA adjustment). Additionally, the user or input device (e.g., a laser rangefinder) inputs a range to a target, which is 1,300 yards in each of the previous examples of this disclosure.

The method 490 includes a first subprocess of computing 500, for a moving target, an amount and direction of the target's predicted movement. In some embodiments, the subprocess of computing 500 and the method 490 in general may compensate for motion attributable to range changes of a target moving away from or toward a shooter. Such range changes would result in additional vertical target movement adjustment because these changes affect the environmental conditions and superelevation angle for the calculated bullet trajectory. For ease of description, however, the subprocess of computing 500 and the method 490 are described generally in terms of vertical target movement adjustments, irrespective of whether such adjustments are attributable to target range or elevation changes.

As described previously for FIG. 13, a motion prediction is based on a target's previous average movement observed during an initial observation period. The observed motion is extrapolated to predict a target position at a future point in time equal to a bullet's calculated time of flight to the moving target.

There are several techniques for obtaining a measurement of a target's average movement by which to estimate its future position. For example, digital imaging techniques can be used to estimate previous motion of the target, and thereby extrapolate a future position. Accordingly, image processing software may sample an image sensor to obtain successive image data samples representing the field of view 462. Motion of the target 476 relative to stationary background features in the field of view 462 can then be recognized by use of video analytics or other motion estimate techniques for matching corresponding background or foreground features present in two image data samples and determining displacement or change in scale between target features, relative to the matching background features, between the two samples. The motion, divided by a sampling time between the two samples, may be used to obtain target speed and direction, which would then be used to extrapolate the future position according to motion estimation algorithms. In another example, accelerometers or multi-axis gyroscopic sensors in a rangefinding device may also be used to measure movement of the rangefinding device while a user tracks the moving target so that the measured movement of the rangefinding device can be filtered and used to estimate the target's movement in the field of view 462. In some embodiments, motion of the rangefinding device may be offset by motion of the target within the field of view so as to suppress any jitter of the rangefinding device that is inadvertently introduced by the user.

The subprocess of computing 500 provides as output a vertical target movement adjustment used for establishing 506 an initial vertical aiming adjustment, and a horizontal target movement adjustment used for offsetting 510 a windage adjustment and thereby calculating the horizontal aiming adjustment amount.

For determining the vertical aiming adjustment, the method 490 includes establishing 506 an initial vertical aiming adjustment by calculating a difference between the vertical target movement adjustment (obtained from the subprocess of computing 500) and an initial elevation adjustment. As described previously with respect to the start 284 of the method 280, initial ballistics inputs may be used to calculate an initial elevation adjustment amount (e.g., the aforementioned 50.0 MOA adjustment) and to initialize an iteratively adjusted superelevation angle $\alpha_{ADJ}$ as being equal to the zeroed superelevation angle $\alpha$.

After the initial vertical aiming adjustment, a sequence of process elements shown in rectangular-shaped blocks identified as an element 520, an element 522, and an element 526 are performed according to the previous description of similar elements of FIG. 6 identified as, respectively, the element 290, the element 294, and the element 300. The difference between the elements is that the ones of FIG. 6 iteratively adjust an elevation aiming adjustment, whereas the ones of FIG. 14 iteratively adjust a vertical aiming adjustment that may include both elevation and vertical target movement adjustments. The decision element 292 is the same for both the method 280 and the method 490.

For determining the horizontal aiming adjustment, the method 490 is substantially the same as the method 320 because horizontal movement of a target does not introduce changes to superelevation or environmental conditions. The method 490, therefore, includes the offsetting 510 of the horizontal aiming adjustment by the horizontal target movement adjustment, and outputting 530 the result.

The method 490 also includes an optional presenting 534 of the aiming adjustment. For example, the presenting 534 may include superimposing (e.g., rendering on a display) in the field of view 462 the first circular component 470 and the second x-shaped component 486.

Skilled persons will understand that many changes may be made to the details of the above-described embodiments without departing from the underlying principles of the invention. For example, skilled persons will recognize that the examples referring to bullets and the like are also applicable to other projectiles, such as, for example, arrows. The scope of the present invention should, therefore, be determined only by the following claims.

The invention claimed is:

1. In a projectile-trajectory determining system providing an aiming adjustment amount that is initially determined based on a line of sight intersecting a preselected zero range, a method of determining a ballistic solution to shoot a target located at a target location at a target range that is different from the preselected zero range, the method comprising:

iteratively calculating an amount of a ballistics trajectory parameter representing a predicted deviation of a projectile trajectory from the target location at the target range, including:

(a) estimating a target movement adjustment amount;

(b) calculating the amount of the ballistics trajectory parameter based on the aiming adjustment amount, in which the aiming adjustment amount includes the target movement adjustment amount;

(c) determining whether the amount of the ballistics trajectory parameter is less than a predetermined threshold amount; and (d) in response to determining that the amount of the ballistics trajectory parameter is not less than the predetermined threshold amount, refining the aiming adjustment amount by the amount of the ballistics trajectory parameter and repeating steps (b) through (d); and in response to determining the amount of the ballistics trajectory parameter is less than the predetermined threshold amount, providing an indication of the aiming adjustment amount as a ballistic solution for shooting the target.

2. The method of claim 1, in which repeating of step (a) comprises calculating environmental ballistics conditions at the aiming adjustment amount and recalculating the ballistics trajectory parameter as a function of the environmental ballistics conditions.

3. The method of claim 1, in which repeating of step (a) comprises adjusting a superelevation angle by a difference of a first sight-height depression angle and a second sight-height depression angle, the first sight-height depression angle being between an inclination line to the target location and the line of sight intersecting the preselected zero range, the second sight-height depression angle being between the inclination line to the target location and a calculated line of sight intersecting a location along the calculated line of sight at the target range.

4. The method of claim 1, in which the ballistics trajectory parameter is a projectile path parameter.

5. The method of claim 1, in which the aiming adjustment amount comprises a vertical aiming adjustment amount.

6. The method of claim 5, in which the vertical aiming adjustment amount comprises an elevation aiming adjustment amount.

7. The method of claim 5, in which the vertical aiming adjustment amount comprises a vertical target movement adjustment amount.

8. The method of claim 1, in which the ballistics trajectory parameter is a deflection parameter.

9. The method of claim 1, in which the aiming adjustment amount comprises a horizontal aiming adjustment amount.

10. The method of claim 9, in which the horizontal aiming adjustment amount comprises a windage aiming adjustment amount.

11. The method of claim 9, in which the horizontal aiming adjustment amount comprises a horizontal target movement adjustment amount.

12. The method of claim 1, further comprising:

receiving updated ballistic parameter input information; and in response to receiving the updated ballistic parameter input information, dynamically updating the aiming adjustment amount based on the updated ballistic parameter input information.

13. The method of claim 1, in which the projectile-trajectory determining system comprises a reticle encompassing a field of view that includes the target location, and in which the providing the indication of the aiming adjustment amount as the ballistic solution for shooting the target location at the target range comprises superimposing an aiming mark in the field of view at a location corresponding to the aiming adjustment amount.

14. The method of claim 13, further comprising dynamically updating the location corresponding to the aiming adjustment amount based on updated ballistic parameter input information received by sampling environmental conditions.

15. The method of claim 13, further comprising dynamically updating the location corresponding to the aiming adjustment amount based on updated ballistic parameter input information received by updating the target range.

16. The method of claim 13, in which the aiming mark indicates a calculated velocity so as to represent a projectile's velocity at the target range.

17. The method of claim 1, further comprising:

determining a predicted velocity of the projectile expected at the target range; and if the predicted velocity of the projectile at the target range is expected to be transonic or subsonic, displaying a warning indicator to a user.

18. The method of claim 17, in which the projectile-trajectory determining system comprises an optical sighting device, and in which the step of displaying the warning indicator to the user includes superimposing the warning indicator in a field of view viewable with the optical sighting device.

19. The method of claim 1, further comprising:

determining a superelevation angle of a first load; and providing the indication of the aiming adjustment amount as the ballistic solution for shooting the target location located at the target range by generating the ballistic solution for a target load relative to the superelevation angle of the first load.

20. A riflescope configured to perform the method of claim 1.

21. A rangefinder configured to perform the method claim 1.

22. A machine-readable medium including instructions stored thereon that, when executed by a processing device, cause the processing device to perform the method of claim 1.

23. A ballistics calculator software application configured to perform the method of claim 1.

24. A method of operating a projectile-trajectory determining system for use in shooting a projectile at a target located at a target range, the method comprising:

determining a predicted velocity of the projectile at the target range; and if the predicted velocity at the target range is transonic or subsonic, displaying to a user a warning indicator to alert the user that the projectile is expected to begin transitioning from supersonic velocity to subsonic velocity before it arrives at the target.

25. The method of claim 24, further comprising:

determining an aiming adjustment for a projectile weapon shooting the projectile at the target; and displaying an indication of the aiming adjustment.

26. The method of claim 25, in which the displaying of the warning indicator includes displaying the warning indicator in a color different from a color of the indication of the aiming adjustment.

27. The method of claim 25, in which the projectile-trajectory determining system includes a reticle encompassing a field of view that includes the target location, and in which the method further comprises displaying an aiming mark via the reticle, the aiming mark superimposed on the field of view at a location corresponding to the aiming adjustment.

28. The method of claim 27, in which the displaying of the warning indicator includes displaying the warning indicator via the reticle and in a color different from a color of the aiming mark.

29. The method of claim 27, further comprising displaying, via the reticle the predicted velocity of the projectile at the target range.

30. The method of claim 24, in which:

the projectile-trajectory determining system comprises an optical sighting device having a field of view; and the displaying of the warning indicator includes superimposing the warning indicator onto the field of view of the optical sighting device.

31. The method of claim 24, further comprising:

sensing one or more environmental conditions; and measuring the target range, and wherein:

the determining of the predicted velocity of the projectile includes calculating the predicted velocity as a function of the target range and the one or more environmental conditions.

32. The method of claim 24, in which the displaying of the warning indicator includes displaying the warning indicator in a yellow or red color.

* * * * *